US005337994A

United States Patent [19]

Vipond et al.

[11] Patent Number: 5,337,994

[45] Date of Patent: Aug. 16, 1994

[54] APPARATUS FOR MOUNTING A PORTABLE VENTILATION FAN TO AN ACCESS PORT

[75] Inventors: Edward W. Vipond, Gardner; Mark S. Chumsae, Shrewsbury, both of Mass.

[73] Assignee: Tuthill Corporation, Millbury, Mass.

[21] Appl. No.: 66,997

[22] Filed: May 24, 1993

[51] Int. Cl.[5] ..... A47F 5/00

[52] U.S. Cl. ..... 248/289.1; 454/48; 454/338

[58] Field of Search ..... 248/289.1, 291, 293, 248/299; 454/48, 49, 338, 341, 354

[56] References Cited

U.S. PATENT DOCUMENTS

| | | | |
|---|---|---|---|
| 497,388 | 5/1893 | Ross | 454/48 |
| 4,123,968 | 11/1978 | Malott | 248/221.3 X |
| 4,977,884 | 12/1990 | Kaufman | 454/354 X |

*Primary Examiner*—Ramon O. Ramirez
*Attorney, Agent, or Firm*—Samuels, Gauthier & Stevens

[57] ABSTRACT

An apparatus for mounting a portable ventilation fan at an access port in the wall of an enclosure. The apparatus comprises a fixable base plate having a first opening extending therethrough, and which is detachably mounted to the port with the first opening in alignment with the port opening. A swing plate having a second opening extending therethrough is pivotably coupled to the base plate for pivotal movement between a closed position in which the first and second openings are aligned and an open position. The fan is detachably coupled to the swing plate so that the fan is in alignment with the second opening, whereupon when the swing plate is in the closed position, the fan is operable to promote a flow of air through the access port via the first and second openings. A retaining mechanism yieldably retains the swing plate in the closed position so as to resist fan reactionary forces tending to pivotably displace the swing plate from the closed position, while permitting the swing plate to be readily pivoted to the open position by personnel seeking to enter or exit the enclosure via the access port in an emergency.

10 Claims, 1 Drawing Sheet

APPARATUS FOR MOUNTING A PORTABLE VENTILATION FAN TO AN ACCESS PORT

BACKGROUND OF THE INVENTION

The invention relates to apparatus for mounting portable ventilation fans to access ports in the walls of enclosures.

Portable ventilation fans are utilized in critical areas to protect against hazardous fumes and gases by removing same from, or providing fresh air to confined spaces. For example, enclosures such as crack towers used in petroleum refineries often require interior access by personnel in order to carry out sandblasting, welding, painting or other maintenance operations. The use of the ventilation fans create a safer and more comfortable working environment for the personnel by both removing noxious fumes and cooling the air within the tower.

The large enclosures in the form of tanks or vessels, typically include a plurality of man-ways which allow access into the confined areas. Conventional ventilation systems are configured to adapt a ventilation fan to one or more of the man-ways in a secured and stably mounted position, typically by bolting the fan directly to the exterior of the man-way. The fans are aligned with the opening of the port to provide the appropriate air flow therethrough. Unfortunately, due to the conventional adaptation of the fans to the man-ways, the number of ports which will serve as access ports or exits from the inside the enclosure are reduced, thus creating a potential hazard.

It is therefore an object of the present invention to provide an apparatus for mounting a ventilation fan to an access port of an enclosure while maintaining the port's capability as an access or escape route for personnel.

SUMMARY OF THE INVENTION

The present invention provides an apparatus for mounting a portable ventilation fan at an access port in the wall of an enclosure. The apparatus comprises a fixable base plate having a first opening extending therethrough, and which is detachably mounted to the port with the first opening in alignment with the port opening. A swing plate having a second opening extending therethrough is pivotably coupled to the base plate for pivotal movement between a closed position in which the first and second openings are aligned and an open position. A coupling means is provided for detachably coupling the fan to the swing plate such that the fan is in alignment with the second opening, whereupon when the swing plate is in the closed position, the fan is operable to promote a flow of air through the access port via the first and second openings. A retaining means yieldably retains the swing plate in the closed position so as to resist fan reactionary forces tending to pivotably displace the swing plate from the closed position, while permitting the swing plate to be readily pivoted to the open position by personnel seeking to enter or exit the enclosure via the access port.

DETAILED DESCRIPTION OF THE ILLUSTRATED EMBODIMENTS

Figure 1:
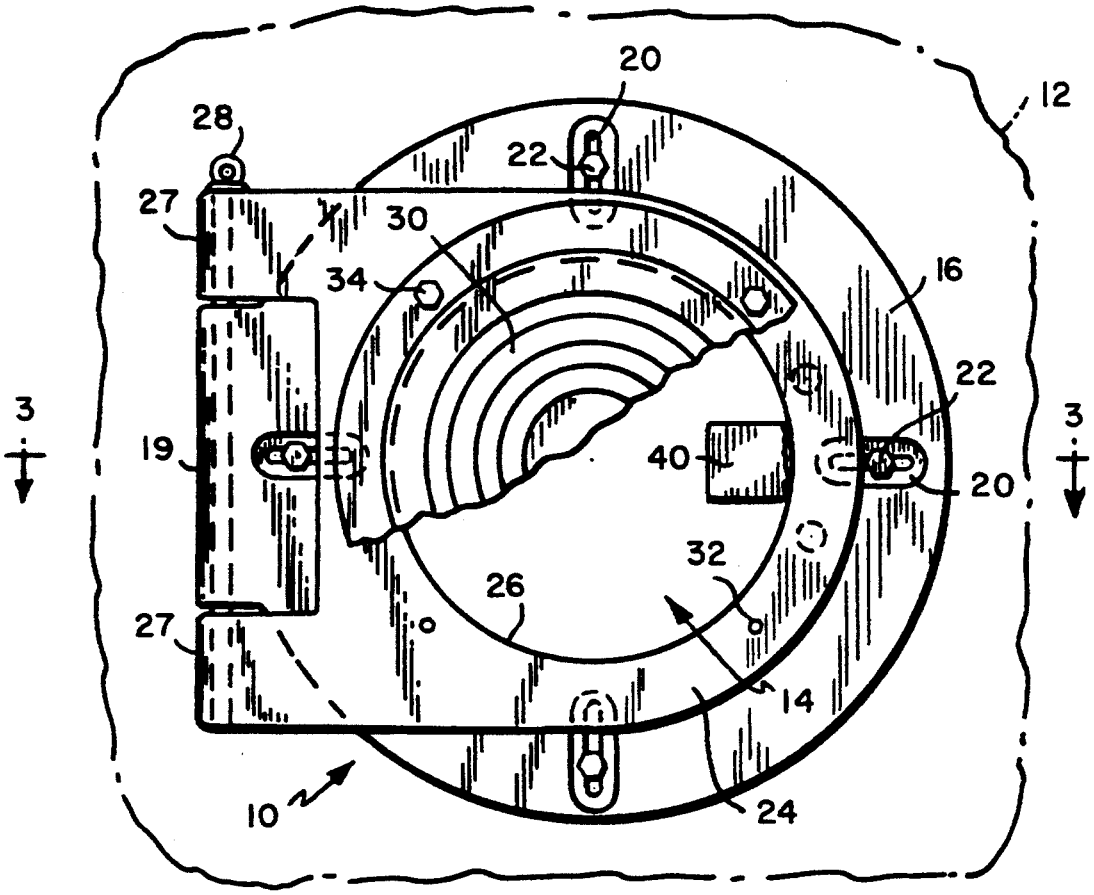
FIG. 1 shows a frontal view of a exhaust fan mounting apparatus in accordance with the present invention.

FIG. 1 shows a fan mounting apparatus in accordance with the present invention for coupling a supply or exhaust fan 30 to an access port or man-way 14 of an enclosure wall 12. The exhaust fan may, for example, be a reaction fan type ventilator manufactured by Tuthill Corporation, Coppus Portable Ventilation Division. The access port of the enclosure wall leads to the interior of an enclosure such as a crack tower, gas tank, or any enclosure which would require interior access by maintenance personnel.

The mounting apparatus 10 comprises a fixable base plate 16 which includes an opening 18 therethrough. The base plate is preferably circular in shape and includes a hinge extension 19. A plurality of mounting slots 20 are provided around the circumference of the base plate. The mounting slots accommodate detachable mounting of the base plate to the enclosure wall 12, so that the base plate opening may be in line with the access port 14 which may vary in diameter. Bolts 22 or other conventional securing devices are utilized to detachably mount the base plate to the enclosure wall.

Figure 2:
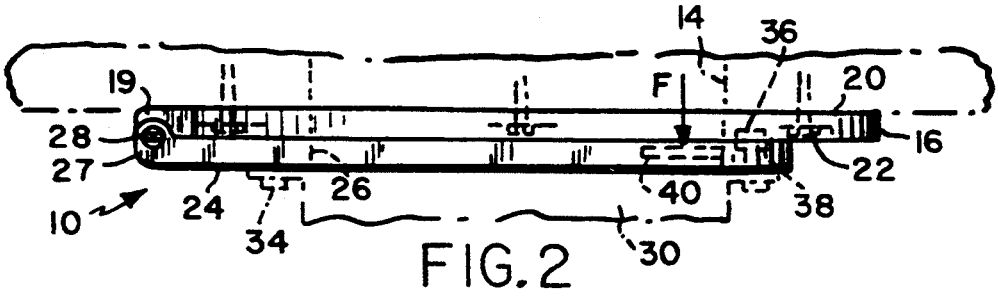
FIGS. 2 and 3 show top plan views of the exhaust fan mounting apparatus in a closed and an open position, respectively.
Figure 3:
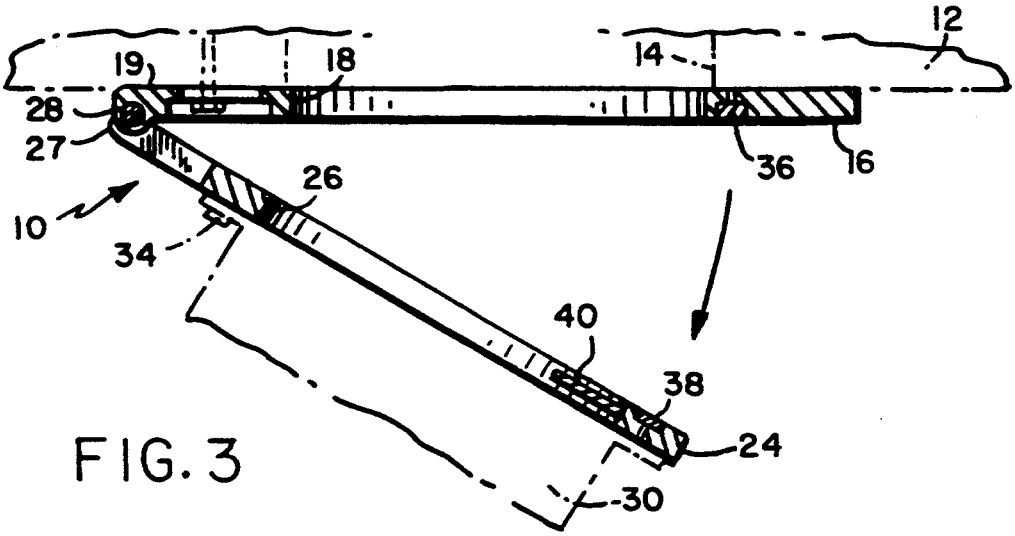

A swing plate 24 having an opening 26 is pivotably coupled to the hinge extension 19 of the base plate with hinge extensions 27 and a hinge pin 28. Thus, the swing plate is adjustable between a closed position, as shown in FIG. 2, wherein the swing plate is overlying and generally parallel to the base plate with the swing plate opening 26 being in alignment with the base plate opening 18, and an open position, as shown in FIG. 3, wherein the swing plate is disposed angularly with respect to the base plate.

The swing plate 24 includes a plurality of fan mounting holes 32 disposed about the periphery of the swing plate opening 26. Bolts or other securing devices are utilized to detachably mount the fan 30 to the swing plate using the mounting holes 32. Accordingly, the fan 30 is positioned to be aligned with the swing plate opening 26, whereupon when the swing plate is in the closed position, the fan is operable to promote a flow of air through the access port 14 via the base plate opening 18 and the swing plate opening.

In order to maintain the swing plate 26 in the closed position, the base plate 16 is provided with one or more closure devices 36 which coact with one or more closure devices 38 disposed on the swing plate. For example, the enclosure devices 36 and 38 may be a magnet coacting with an associated metallic contact surface, a hook and loop connector pair, or a pin and socket closing device. The closure devices preferably interact to yieldably retain the swing plate in the closed position, thus resisting fan reactionary forces tending to pivotably dislodge the swing plate from the closed position, while permitting the swing plate to be readily pivoted to the open position by personnel seeking to enter or exit the enclosure through the access port 14.

A kick plate 40 is provided within the swing plate opening to accommodate opening of the swing plate from within the access port 14. As best shown in FIG. 2, a force F applied to the kick plate that overcomes the interaction between the closure devices 36 and 38 will pivot the swing plate into the open position, thus providing an exit from the access port 14.

What is claimed is:

1. An apparatus for mounting a portable ventilation fan at an access port in the wall of an enclosure, comprising:

a base plate having a first opening extending therethrough;

first connecting means for detachably mounting said base plate to said port with said first opening in alignment therewith;

a swing plate having a second opening extending therethrough;

second connecting means for connecting said swing plate to said base plate for pivotal movement between a closed position overlying and generally parallel to said base plate with said second opening in alignment with said first opening, and an open position disposed angularly with respect to said base plate;

third connecting means for detachably connecting said fan to said swing plate at a position aligned with said second opening, whereupon when said swing plate is in said closed position, said fan is operable to promote a flow of air through said access port via said first and second openings; and closure means for yieldably retaining said swing plate in said closed position, said closure means being operative to resist fan reactionary forces tending to pivotally dislodge said swing plate from said closed position, while permitting said swing plate to be readily pivoted to said open position by personnel seeking to enter or exit said enclosure via said access port.

2. The apparatus as claimed in claim 1, wherein said base plate has a generally annular configuration surrounding said first opening, with circumferentially spaced radially extending slots through which said first connecting means extend to accommodate mounting of said base plate to differently sized access ports.

3. The apparatus as claimed in claim 2, wherein said first connecting means comprise bolts extending through said slots into threaded engagement with holes in said wall.

4. The apparatus of claim 1, wherein said closure means is disposed at the interface between said base plate and said swing plate.

5. The apparatus of claim 4, wherein said closure means comprises at least one magnet coacting with an associated metallic contact surface.

6. The apparatus of claim 4, wherein said closure means comprises a hook and loop connector.

7. An apparatus for mounting a fan to an access port of an enclosure, comprising:

a base plate having a first opening extending therethrough, and being detachably mounted to said port so that said first opening is in alignment with said port;

a swing plate having a second opening extending therethrough, said swing plate being pivotably coupled to said base plate for pivotal movement between a closed position in which said first and second openings are aligned and an open position;

coupling means for detachably coupling said fan to said swing plate such that said fan is in alignment with said second opening, said fan providing a flow of air through said access port via said first and second openings when said swing plate is in said closed position; and retaining means for yieldably retaining said swing plate in said closed position so as to resist fan reactionary forces tending to pivotably displace said swing plate from said closed position.

8. The apparatus of claim 7, wherein said retaining means comprises a magnetic connection between said base plate and said swing plate.

9. The apparatus of claim 8, wherein said retaining means comprises at least one magnet coacting with an associated metallic contact surface.

10. The apparatus of claim 7, wherein said retaining means comprises a hook and loop connection between said base plate and said swing plate.

* * * * *